US005876232A

United States Patent [19]

Matsushita et al.

[11] Patent Number: 5,876,232

[45] Date of Patent: Mar. 2, 1999

[54] INERTIA LOCKING CONNECTOR

[75] Inventors: Yasuo Matsushita; Mitsuhiro Fujitani, both of Yokkaichi, Japan

[73] Assignee: Sumitomo Wiring Systems, Ltd., Japan

[21] Appl. No.: 842,478

[22] Filed: Apr. 23, 1997

[30] Foreign Application Priority Data

Apr. 26, 1996 [JP] Japan ..... 8-108290

[51] Int. Cl.[6] ..... H01R 13/627

[52] U.S. Cl. ..... 439/357

[58] Field of Search ..... 439/350, 352, 439/353, 354, 357, 358, 372, 488

[56] References Cited

U.S. PATENT DOCUMENTS 5,403,199 4/1995 Mobley et al. ..... 439/357
5,692,923 12/1997 Sawada ..... 439/350 X

FOREIGN PATENT DOCUMENTS 249080 4/1990 Japan .
295174 7/1990 Japan .
3196478 8/1991 Japan .
4220972 8/1992 Japan .

*Primary Examiner*—Khiem Nguyen
*Attorney, Agent, or Firm*—Jordan B. Bierman; Bierman, Muserlian and Lucas

[57] ABSTRACT

An inertia locking connector including elements which provide resistance to fitting the male and female connectors together. A consistent operating feel is obtained, even if the locking arm is released by the user. A resistance arm, independent of the locking arm, engages a rib of the male connector. A detent which is engaged by the locking arm is located on the same surface of the male connector as is the rib. The latter acts as a temporary stop for the resistance arm. Therefore, the user must exert substantial increased pressure to cause the resistance arm to flex out of contact with the leading edge thereof. As a result, the increased force builds momentum in the moving connectors so that the locking arm rides positively over the detent into its proper locking position.

8 Claims, 5 Drawing Sheets

INERTIA LOCKING CONNECTOR

This Application claims the benefit of the priority of Japanese 8-108290, filed Apr. 26, 1996.

The present Invention is directed to an improved form of inertia locking connector, in particular, a device which can be readily and reliably assembled.

BACKGROUND OF THE INVENTION

When connectors are to be mated to each other, it is important that one be fully inserted and locked into the other. If there is insufficient resistance to the insertion, the danger arises that the assembler will not press the two parts together with sufficient force and, as a result, incomplete assembly is achieved. On the other hand, if excessive fitting resistance is provided, the operator may get a false impression that fitting has been completed when, in fact, this is only partially so.

To overcome the foregoing problem, an inertia locking mechanism is used. This generates an initial resistance to fitting which is greater than the fitting resistance between the terminals themselves. When the initial resistance is overcome, this resistance is quickly relaxed. This provides consistency of feel so that the operator can better judge when fitting is complete. Moreover, the momentum of the connector, which results from the release of the initial resistance, aids in completing the fitting operation.

A device of the foregoing type is shown in cross section in FIG. 7. First connector 1 is provided with locking arm 2. Second connector 3 has corresponding engagement portion 4 located thereon. When first connector 1 and second connector 3 are fitted together, locking arm 2 rides up over engagement portion 4 until it is in contact with the rear face thereof, thus locking the two parts together. The fitting resistance is generated by the front of engagement portion 4 contacting the distal end of locking arm 2. When this is overridden, locking is complete.

However, since such structure requires a substantial force to complete the fitting operation, users sometimes press down on the rear of locking arm 2 to deliberately disengage it so as to facilitate joinder of the connectors. However, since this prevents locking arm 2 from contacting engagement portion 4, the fitting resistance is either absent or substantially reduced. As a result, there is no consistent feel and it is difficult for the operator to know whether the assembly is complete.

An alternative device is disclosed in Japanese Utility Model Laid-Open Publication 2-95174 and is shown in perspective in FIG. 8 hereof. There is provided a pair of spaced apart locking arms 5. Between them, resistance arm 6 is located. Locking arms 5 act in the same way as the corresponding locking arm previously described. In this structure, resistance arm 6 is substantially inflexible, thereby providing a consistent feel for the operator. However, the actuating surface of resistance arm 6 is so located that it is contacted by the engagement portion of the mating connector (not shown) at the same time as locking arms 5. This creates a very large pressure and makes it difficult for the operator to fit the devices together completely. Moreover, since resistance arm 6 is located between locking arms 5, the latter are displaced outward to provide the necessary space therefor. Thus, the engagement portion of the complementary connector must also be offset outward, thus requiring a different shape thereof.

SUMMARY OF THE INVENTION

It is, therefore, an object of the present Invention to provide a device for generating suitable fitting resistance which will give a consistent operating feel, even if the locking arm is unlocked. It is also an object of the present Invention to provide the foregoing without the necessity of changing the shape of the complementary connector.

The present Invention is directed to male and female locking connectors with a detent on one connector and a locking element on the other. The locking element rides up over the detent during locking movement and drops down on the other side, thereby bearing against the rear face of the detent and locking the two connectors together. To release, the locking element is disengaged from the detent, usually by pressing on the proximal end thereof.

There is also provided at least one resistance surface on one of the connectors and a corresponding resistance element, independent of the locking element, on the other connector. The resistant element bears against the resistance surface to generate the desired resistance to movement of the two connectors into their locking position. The resistance element has a leading end facing the leading edge of the resistance surface. They are advantageously located so that the leading edge and leading end contact each other during the fitting movement of the connectors before the locking element contacts the detent. Thus, the initial resistance is created and preferably released before the locking element reaches the detent. Thus, by pressing the two parts together, momentum is built up which will carry the locking element over the detent and into its proper locked position. The leading edge of the resistance surface may be slanted to allow the resistance element to ride thereover without damage to any of the components of the connectors.

In a preferred form of the device, the leading edge is substantially transverse to the direction of fitting movement and the resistance element has a protuberance adjacent the distal end thereof. This protuberance extends in a transverse direction toward the resistance surface. Therefore, the leading edge contacts the resistance element at a point on the protuberance which is eccentric to the axis of the resistance element. As a result, pressure in the fitting direction causes the resistance element to bend and thereby slide over the leading edge.

Advantageously, there is provided a pair of resistance elements in the form of upstanding generally planar ribs which are transversely spaced apart. The resistance element is a pair of elongated resistance arms transversely flexible and biased toward the ribs. In this embodiment, the detent is located between the ribs and the locking arm is located between the resistance arms.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
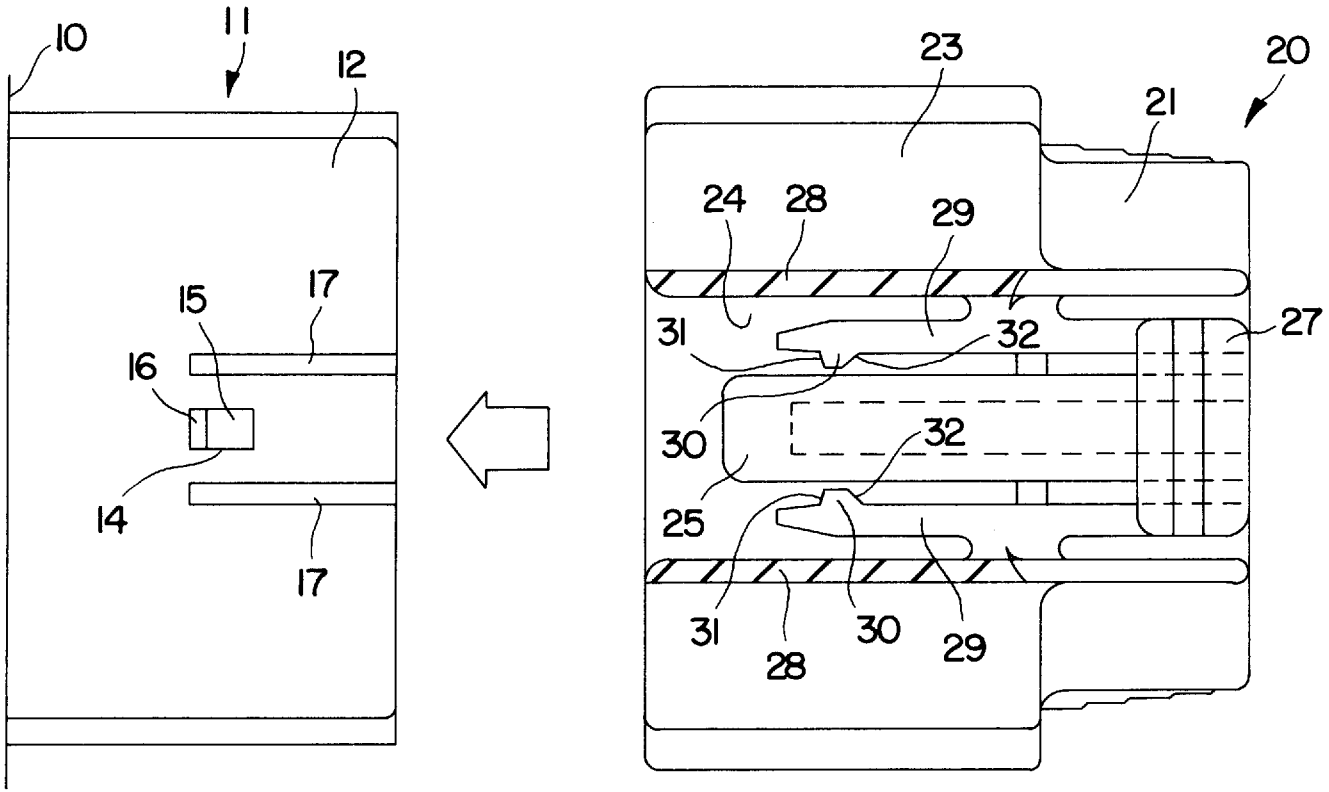
FIG. 1 is a plan view, partly in section, of the male and female connectors according to the Invention before being fitted together.

As shown in FIGS. 1 to 6, female connector 20 is adapted to receive fitting portion 12 on housing 10 of mating connector 11. On the surface thereof, connector 11 is provided with detent 14 with guide surface 15 and engagement surface 16. Male terminal 13 is located within fitting portion 12.

Female connector 20 comprises housing 21 and hood 23. Female terminal 22 is located within the housing. Locking arm 25 is provided on one surface thereof and is complementary to detent 14. On either side of locking arm 25 are resistance arms 29. Each arm carries projection 30 which is provided with contact surface 31 and guide surface 32. Arms 29 are flexible in a direction transverse to the insertion direction and active space 24 is located between side walls 28 and resistance arms 29 for this purpose.

Figure 2:
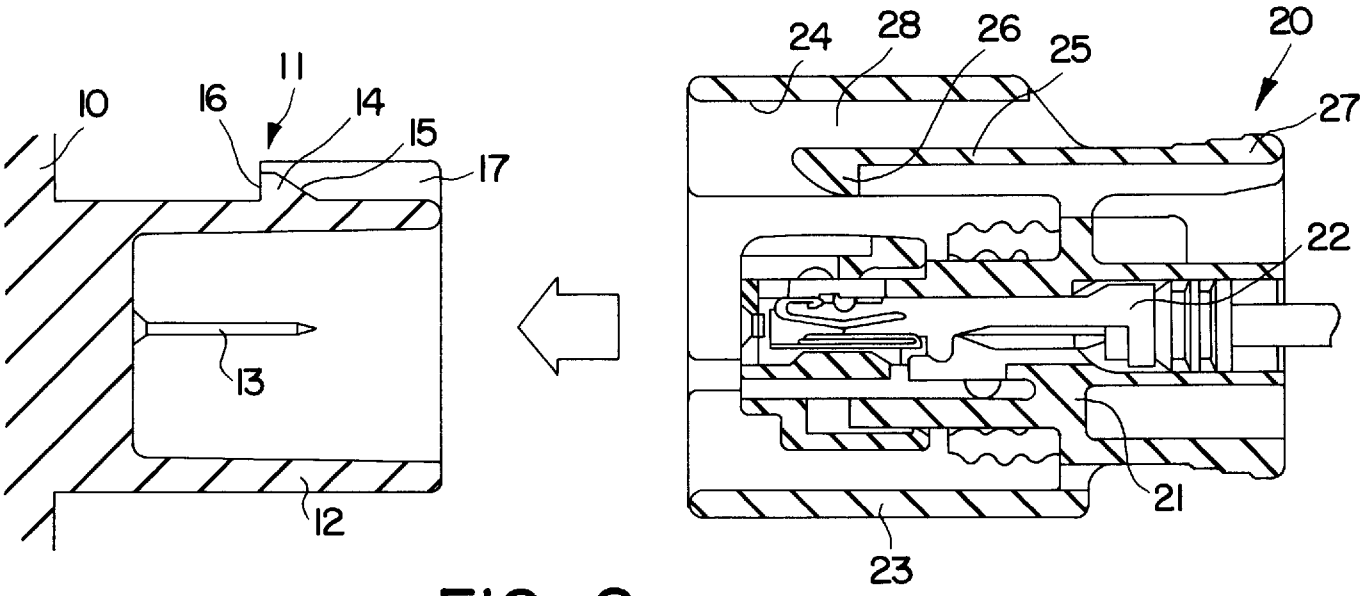
FIG. 2 is an elevation of the connectors of FIG. 1 in section.
Figure 5:
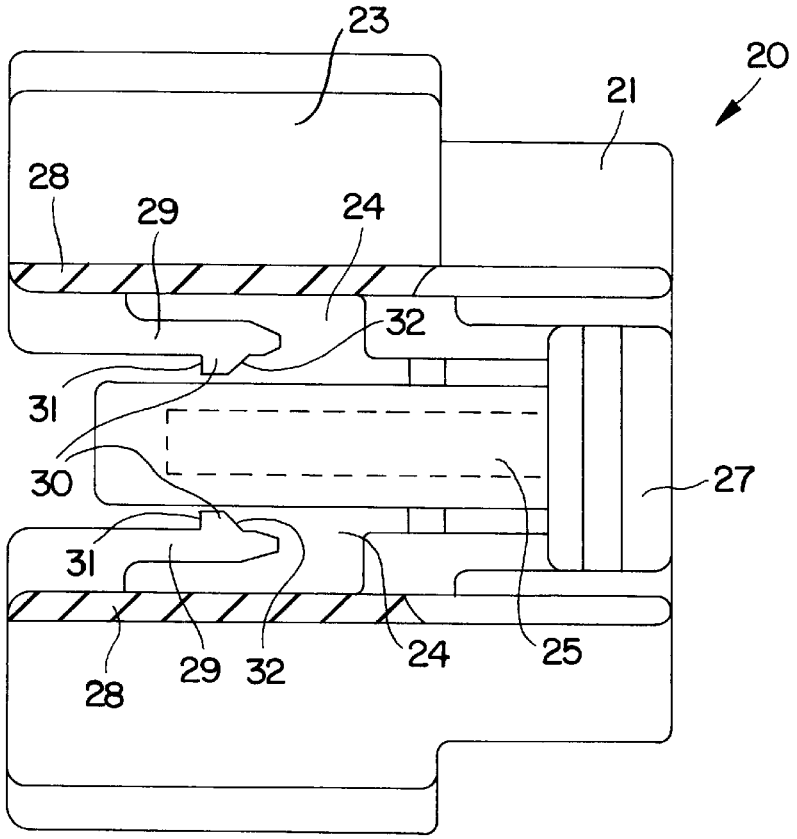
FIG. 5 is a plan view, partly in section, of a modification of the Invention.
Figure 6:
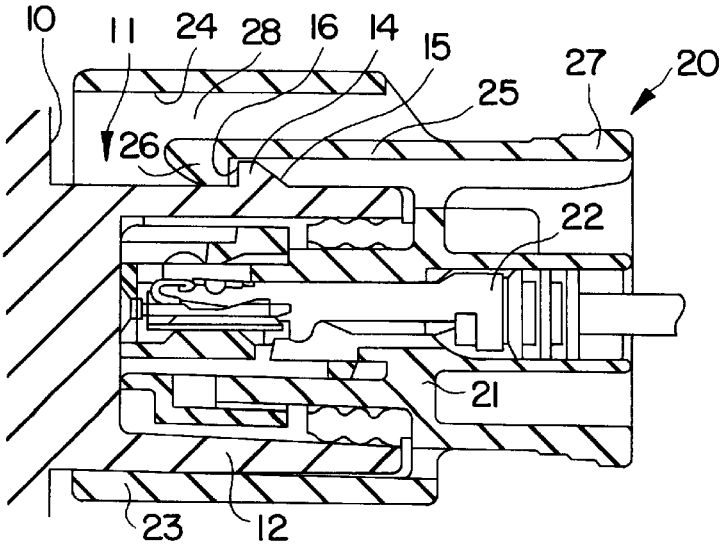
FIG. 6 is a sectional elevation of FIG. 4.
Figure 7:
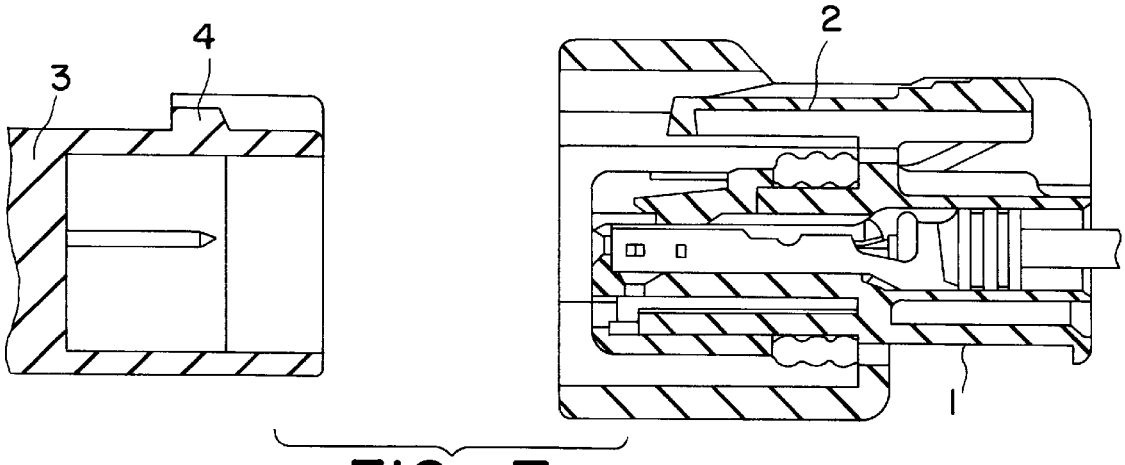
FIG. 7 is a view similar that of FIG. 2 of a prior art device.
Figure 8:
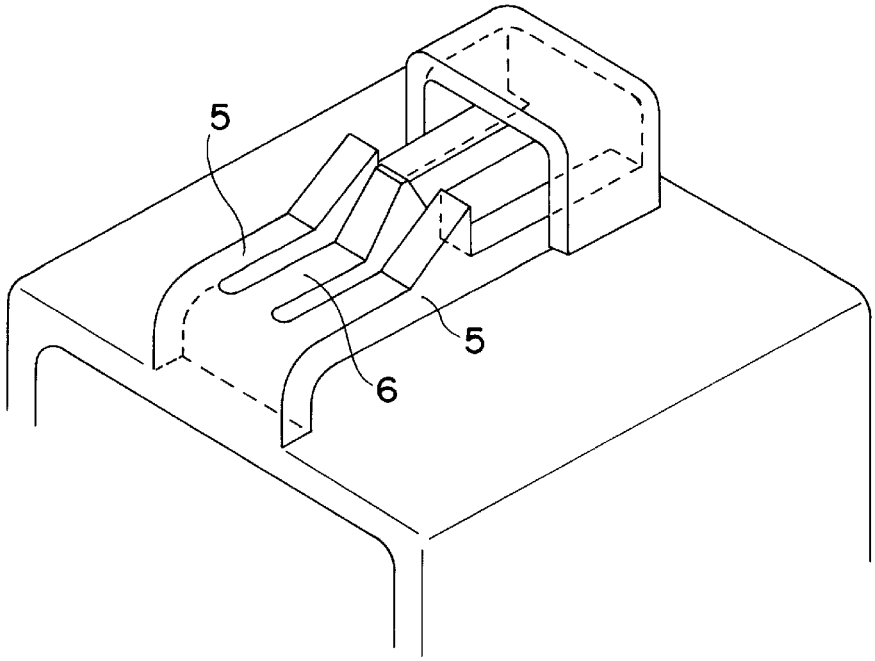
FIG. 8 is a perspective view of another prior art device.

In one form of the Invention, engagement surface 16 is slanted, as shown in FIG. 1, to facilitate disengagement of the connectors. Alternatively, as shown in FIG. 2, engagement surface 16 can be vertical. In this case, the connectors are disengaged by pressing on pressing portion 27 which causes engagement projection 26 to move upwardly (as shown in FIG. 2) so that it is no longer in contact with engagement surface 16. Another variation is shown in FIG. 5. There, resistance arms 29 extend from the front of connector 20 toward the rear thereof.

Figure 3:
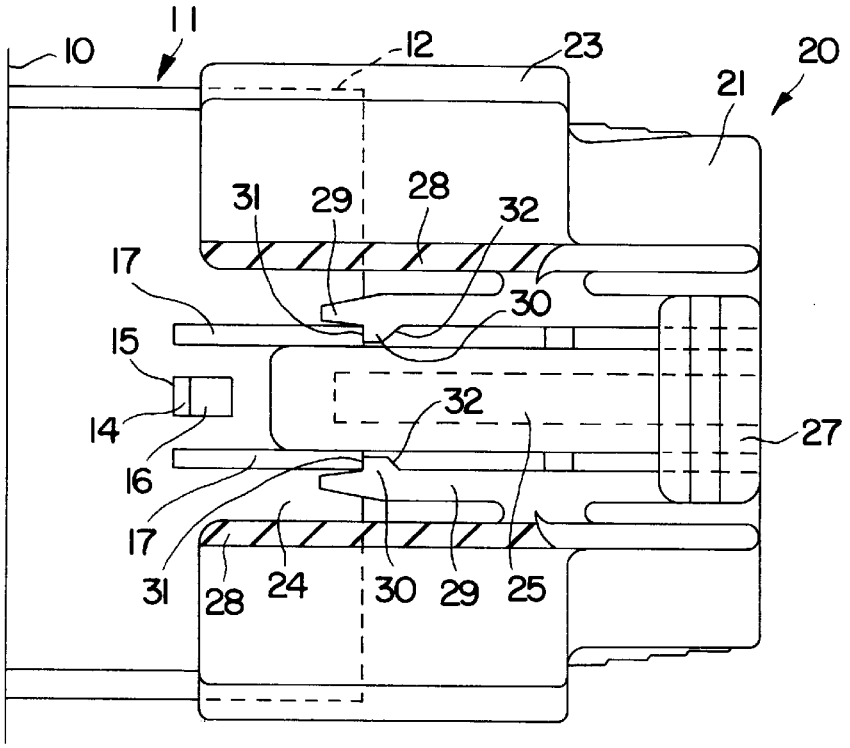
FIG. 3 is a plan view, similar to that of FIG. 1, with the connectors in the partially fitted position.

To assemble the device, fitting portion 12 of connector 11 is inserted into hood 23. Partial insertion is shown in FIG. 3. As can be seen there, contact surfaces 31 are in contact with the leading edges of ribs 17. Further pressure is then exerted which causes resistance arms 29 to bend inwardly, thereby slanting contact surfaces 31. This causes resistance arms 29 to spread and ride up over the outside of ribs 17.

Figure 4:
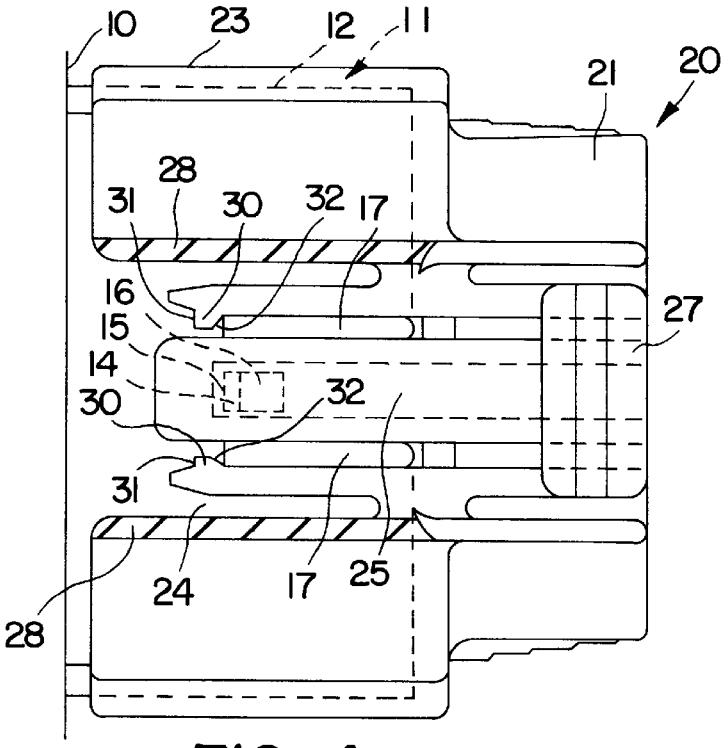
FIG. 4 is a plan view, similar to that of FIG. 3, showing the connectors fully locked.

Because of the initial force required to spread resistance arms 29, considerable momentum is developed between connectors 20 and 11, whereby locking arm 25 rides over engagement surface 16 into the position shown in FIGS. 4 and 5. As a result, the rear face of engagement projection 26 bears against engagement surface 16, thereby locking the connectors together securely. If they are to be disengaged, pressure is exerted on pressing portion 27, causing engagement projection 26 to move upwardly (as shown in FIG. 5) so that the connectors can easily be separated.

The provision of locking arm 25 centrally of the transverse dimension of connector 20, coupled with the pair of resistance arms 29 spaced symmetrically on either side, permits the fitting resistance from resistance arms 29 to act uniformly on both sides of the device. Thus, no tilting of the connectors will occur. Also, the use of two resistance arms 29 doubles the fitting resistance obtained. Since the size and/or shape of female connector 20 is unchanged by the present device, it is capable of use with existing male connectors without any requirement for modification thereof.

Furthermore, if additional fitting resistance is required, it is possible to accomplish this by increasing the width of resistance arms 29 in the transverse direction. Since the increased dimension is parallel to the upper surface of female housing 21, no increase in height thereof is necessary. The provision of substantial space 24 eliminates the necessity to increase the lateral width of housing 21. Thus, the present Invention is capable of providing substantially increased fitting resistance as desired, without any need to modify either the height or the width thereof, thereby eliminating the need to redesign existing male connectors.

Certain embodiments of the present Invention have been expressly disclosed. However, it is not limited thereto and various modifications thereof will readily suggest themselves to persons of ordinary skill. For example, a single resistance arm on one side of the locking arm can be used in place of the pair shown in the Figures; this would entail the need for only a single upstanding rib on the connector. Moreover, the resistance arms can flex inwardly (toward the locking arm) rather than outwardly as shown. The locking arm and resistance arms have been described as being located on the female connector, while the detent and ribs are on the male connector. However, within the spirit and scope of the Invention, one or both of the elements on the female connector can be located on the male connector, and vice versa. In the accompanying Figures, the resistance arms flex in a direction parallel to the upper surface of the connector. Alternatively, flexure can take place perpendicularly to the upper surface with substantially the same effect. In that case, spaces 24 would be located between the upper surface and the resistance arms.

Although only a limited number of specific embodiments of the present Invention have been expressly disclosed, it is, nonetheless, to be broadly construed, and not to be limited except by the character of the claims appended hereto.

What we claim is:

1. An inertia locking connector comprising a male connector, having a male terminal, and a female connector, having a female terminal adapted to mate with said male terminal when said male connector and said female connector are in a locked position relative to each other, a detent on one of said male connector and said female connector, a locking element on another of said male connector and said female connector, said locking element engaging said detent when said male connector and said female connector are in said locked position, a resistance surface on one of said male connector and said female connector, a resistance element, independent of said locking element, on another of said male connector and said female connector, said resistance element adapted to bear against said resistance surface, thereby to generate resistance to movement of said female connector and said male connector into said locked position, said resistance element having a leading end facing a leading edge of said resistance surface, said leading end and said leading edge being in contact with each other during said movement before said male terminal contacts said female terminal, said leading edge and said leading end, when in contact with each other, providing greater resistance to said movement than when said resistance element is in contact with said resistance surface, and said leading edge and said leading end are no longer in contact with each other, said resistance element being a resistance arm having a longitudinal axis, flexible in a transverse direction to said movement, and biased toward said resistance surface, said resistance arm having a projection adjacent said leading end extending in said transverse direction toward said resistance surface, a contact surface on said projection adapted to contact said leading edge at a point eccentric to said axis, whereby said movement causes said resistance arm to bend and said projection to be released from contact with said leading edge.

2. The inertia locking connector of claim 1 wherein said resistance surface is a generally planar upstanding rib extending substantially parallel to said movement, said resistance element is a resistance arm having a longitudinal axis, flexible in a transverse direction to said movement, and biased toward said rib.

3. The inertia locking connector of claim 2 wherein said leading edge is substantially perpendicular to said movement.

4. The inertia locking connector of claim 2 wherein there are two generally planar upstanding ribs spaced apart from each other in said transverse direction and extending substantially parallel to said movement, two resistance arms having longitudinal axes, flexible in said transverse direction, and each biased toward one of said ribs.

5. The inertia locking connector of claim 4 wherein said detent is between said ribs and said locking arm is between said resistance arms.

6. The inertia locking connector of claim 1 wherein said resistance surface is a generally planar upstanding rib extending substantially parallel to said movement.

7. An inertia locking connector comprising a male connector, having a male terminal, and a female connector, having a female terminal adapted to mate with said male terminal when said male connector and said female connector are in a locked position relative to each other, a detent on one of said male connector and said female connector, a locking element on another of said male connector and said female connector, said locking element engaging said detent when said male connector and said female connector are in said locked position, a resistance surface on one of said male connector and said female connector, a resistance element, independent of said locking element, on another of said male connector and said female connector, said resistance element adapted to bear against said resistance surface, thereby to generate resistance to movement of said female connector and said male connector into said locked position, said resistance element having a leading end facing a leading edge of said resistance surface, said leading end and said leading edge being in contact with each other during said movement before said male terminal contacts said female terminal, said leading edge and said leading end, when in contact with each other, providing greater resistance to said movement than when said resistance element is in contact with said resistance surface, and said leading edge and said leading end are no longer in contact with each other, said resistance surface is a generally planar upstanding rib extending substantially parallel to said movement, said resistance element is a resistance arm having a longitudinal axis, flexible in a transverse direction to said movement, and biased toward said rib, said resistance arm having a projection adjacent said leading end extending in said transverse direction toward said resistance surface, a contact surface on said projection adapted to contact said leading edge at a point eccentric to said axis, whereby said movement causes said resistance arm to bend and said projection to be released from contact with said leading edge.

8. The inertia locking connector of claim 1 wherein said leading edge and said leading end cease to be in contact with each other during said movement, and said greater resistance is reduced before said male connector and said female connector have fully reached said locked position.

* * * * *